United States Patent [19]

Hasegawa et al.

[11] 4,014,167

[45] Mar. 29, 1977

[54] ELECTRONIC METRONOME

[76] Inventors: Ryozo Hasegawa, 6-2-10, Nakano, Nakano, Tokyo, Japan; Yasuhiro Saito, 4-38-17, Kitakoiwa, Edogawa, Tokyo, Japan

[22] Filed: Nov. 29, 1974

[21] Appl. No.: 528,564

Related U.S. Application Data

[63] Continuation-in-part of Ser. No. 342,082, March 19, 1973, abandoned.

[30] Foreign Application Priority Data

Mar. 21, 1972 Japan ..... 47-27445

[52] U.S. Cl. ..... 58/130 E; 84/1.03; 84/454; 84/464; 84/484; 84/DIG. 12; 340/371; 340/384 E

[51] Int. Cl.[2] ..... G04F 5/02; G10H 5/06

[58] Field of Search ..... 84/1.03, 454, 464, 484, 84/DIG. 12; 58/130 R, 130 A, 130 C, 130 E; 340/371, 384 R, 384 E

[56] References Cited

UNITED STATES PATENTS

| | | | |
|---|---|---|---|
| 3,180,199 | 4/1965 | Anderson | 84/454 |
| 3,320,608 | 5/1967 | Pande et al. | 340/384 E |
| 3,341,840 | 9/1967 | Berkheiser | 340/384 E |
| 3,467,959 | 9/1969 | Zazofsky | 84/484 X |
| 3,534,649 | 10/1970 | Andersson | 84/484 |
| 3,763,305 | 10/1973 | Nakada et al. | 84/1.03 |
| 3,808,349 | 4/1974 | Baba et al. | 84/484 |
| 3,818,693 | 6/1974 | Allard | 58/130 E |

*Primary Examiner*—Stanley J. Witkowski

[57] ABSTRACT

An electronic metronome with an oscillator for producing a signal of predetermined frequency and a variable divider connected to the oscillator for variably dividing the signal to a signal of lower frequency equal to that of a tempo sound to be obtained. A tempo sound generator is connected to the variable divider and is responsive thereto for generating the tempo sound to be obtained. Apparatus is provided for audibly and/or optically displaying the thusly obtained tempo sound. The electronic metronome is capable of effecting audible and visual display of a down-beat sound and medial-beat sound or any combination thereof besides the tempo sound.

9 Claims, 18 Drawing Figures

OSCILLATOR
166.79 HZ
F1 FLIP FLOP
F2 FLIP FLOP
F3 FLIP FLOP
F4 FLIP FLOP
F5 FLIP FLOP
F6 FLIP FLOP
F7 FLIP FLOP
F8 FLIP FLOP
MULTI-VIBRATOR
M1
SM
O.T.
Sa
Sb
SA
SC
DIVIDING FREQUENCY
33 35 36 38 40 42 43 45 46 48 50 52 54 57 60 63
TEMPO DESIGNATION (PER MINUTE)
(304) 152 76
(288) 144 72
(276) 138 69
(264) 132 66
(252) 126 63
(240) 120 60
(232) 116 58
(224) 112 56
(216) 108 54
208 104 52
200 100 50
192 96 48
184 92 46
176 88 44
168 84 42
160 80 40

ELECTRONIC METRONOME

This is a continuation-in-part of application Ser. No. 342,082, filed Mar. 19, 1973, and now abandoned.

BACKGROUND

1. Field of Invention

The present invention relates to electronic metronomes, and more particularly to electronic metronomes capable of effecting audible and visual display of a tempo sound, a down-beat sound and a medial-beat sound or any combination thereof.

2. Prior Art

In U.S. Pat. No. 3,534,649 is disclosed a metronome which produces audible signals by the use of a transducer, these signals being variable over a predetermined frequency range. Circuits are provided to accentuate selectively different beat signals. A pulse oscillator is employed which produces electrical signals which are applied to the transducer as well as to a countercircuit. A circuit is further provided for selectively applying signals from the counter circuit to produce accentuated audible beat signals. This circuit, however, does not provide a visual type of display as is contemplated within the scope of the present invention.

In U.S. Pat. No. 3,341,840, there is provided a device for furnishing a fixed frequency tone of constant pitch to permit tuning of instruments and a metronomic signal of variable repetition rate. This patent similarly fails to show a visible display of the type with which the present invention is concerned.

U.S. Pat. No. 3,467,959 discloses a metronome having a foot pedal for controlling beat rate over a continuous range and a meter that indicates the beat rate in response to the rate of the beat. This patent also fails to show the visible type of display with which the present invention is concerned as will be disclosed in greater detail hereinafter.

SUMMARY OF INVENTION

An object of the invention is to provide an electronic metronome wherein an oscillator using a tuning fork, quartz oscillator or the like generates an output signal converted by means of a variable divider into tempo signals which are periodically generated in accordance with a desired tempo.

Another object of the invention is to provide an electronic metronome which displays tempo by a flow of light in such a way that light emitting elements arranged are successively operated and scanned in synchronism with tempo signals.

A further object of the present invention is to provide an electronic metronome from which not only simple down-beat signals but also down-beat signals having a relatively long period are obtained by dividing the tempo signals at a desired ratio by means of a variable divider comprising flip-flop circuits and a switch assembly.

A still further object is to provide an electronic metronome capable of producing a down-beat signal with its luminous display produced by the division of the tempo signal independently or simultaneously with the normal tempo signal and its luminous display.

A still further object is to provide an electronic metronome capable of producing a medial beat signal with its luminous display produced by the division of the tempo signal independently or simultaneously with the normal tempo and downbeat signals and their luminous display.

To achieve the above and other objects of the invention, there is provided generally an electronic metronome comprising oscillator means for generating an electronic signal of predetermined frequency, variable divider means coupled to said oscillator means for dividing said frequency, control means to control said divider means and the division of said frequency, and tempo sound generating means coupled to said divider means and controlled by the latter to generate a tempo sound. According to a feature of the invention the metronome may further comprise means for visually indicating said sound.

Stated otherwise the invention provides an electronic metronome comprising an oscillator for producing a signal of predetermined frequency, a variable divider connected to said oscillator for variably dividing the frequency of said signal to a lower frequency, tempo selecting means for selecting the frequency of an output signal from said variable divider so as to be equal to that of a tempo sound to be obtained, a tempo sound generator connected to said divider and responsive thereto for generating said tempo sound, and means for audibly and/or optically displaying said tempo sound generated by said tempo sound generator.

More particularly, an electronic metronome provided in accordance with the invention comprises an oscillator for producing a signal of predetermined frequency, a variable divider connected to said oscillator for variably dividing the frequency of said signal to a lower frequency, temp selecting means for selecting the frequency of an output signal from said variable divider, a scanning circuit connected to said divider and including a plurality of flip-flop circuits, a decoder driver, a light emitting arrangement including a plurality of light emitting elements and connected through said decoder driver which takes out pulse signals counted by said scanning circuit, said scanning circuit including an output terminal and generating at its output terminal a tempo sound signal to be obtained and, further, energizing said light emitting elements in succession in response to the output signal generated by said tempo selecting means whereby a desired tempo is displayed by the light emitting arrangement as a flow of light.

DETAILED DESCRIPTION

The present invention will next be described with reference to the embodiments shown in the accompanying drawings.

Figure 1:
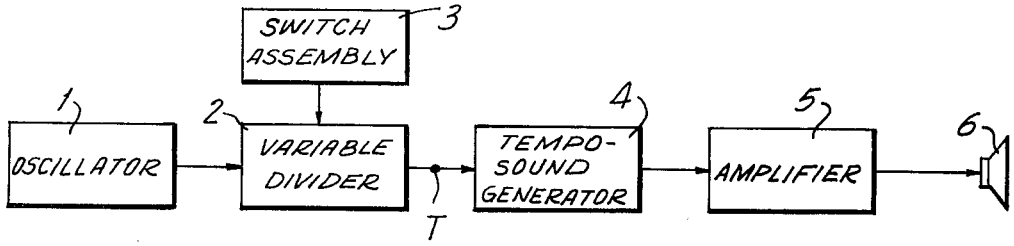
FIG. 1 is a block diagram of a circuit arrangement of an electronic metronome according to the present invention.
Figure 2A:
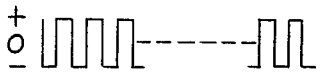
FIGS. 2*a*–2*d* are views showing wave forms for illustrating the function of the circuit arrangement of FIG. 1.
Figure 2B:
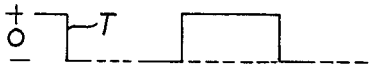
Figure 2C:
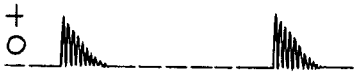
Figure 2D:
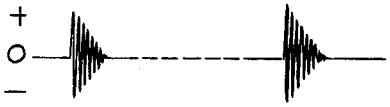

FIG. 1 is a block diagram of an electronic metronome in which a constant-frequency oscillator 1 including a tuning fork, quartz oscillator or the like generates a signal having a frequency of hundreds of Hz to thousands of Hz and having a rectangular wave form as shown in FIG. 2*a*. The signal is then applied to a variable divider 2 to produce tempo signals (see FIG. 2*b*) with the desired tempo frequency due to the operation of a switch 3 as discussed below. A resonance circuit in a temposound generator 4 is triggered by the tempo signals T to produce tempo sound signals as shown in FIG. 2*c*, which are in turn applied to an amplifier 5 for amplification before being supplied to a loud-speaker 6 to produce a desired tempo sound having the wave form as shown in FIG. 2*d*.

Figure 3:
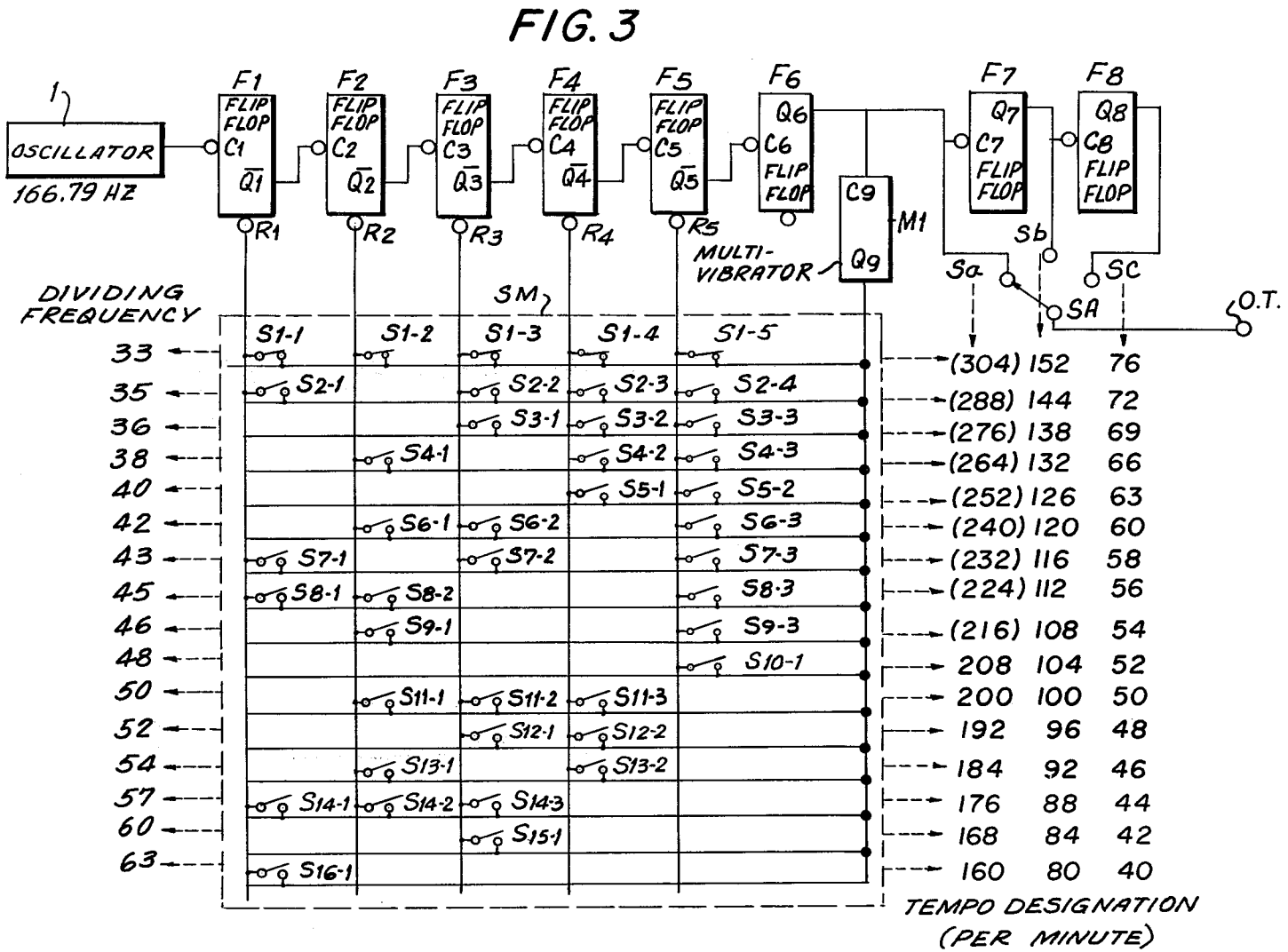
FIG. 3 is a circuit diagram illustrating the main parts of an electronic metronome according to one embodiment of the present invention.

As shown in FIG. 3, the oscillator 1 generates, in this embodiment the frequency 166.79 Hz. The output signal with the rectangular wave form is applied to a trigger input terminal $C_1$ of a flip-flop circuit $F_1$. The reverse output terminal $Q_1$ of the flip-flop circuit $F_1$ is connected to a trigger input terminal $C_2$ of the following flip-flop circuit $F_2$. In this way, flip-flop circuits $F_1$ to $F_6$ are connected in cascaded relation to constitute a 6-bit counter. The output terminal $Q_6$ of the flip-flop circuit $F_6$ is connected to an input terminal $C_9$ of a monostable multivibrator $M_1$, a trigger input terminal $C_7$ of a flip-flop circuit $F_7$ and a contact S*a* of a switch assembly, respectively. An output terminal $Q_7$ of a flip-flop circuit $F_7$ is connected to a trigger input terminal $C_8$ of a flip-flop circuit $F_8$ and a contact S*b* of the switch assembly, and an output terminal Q8 of the flip-flop circuit $F_8$ is connected to a contact Sc of the switch assembly. A movable contactor SA of the switch assembly is connected to an output terminal O.T. Further, an output terminal $Q_9$ of the monostable multivibrator $M_1$ is connected to reset terminals $R_1$ to $R_5$ of the flip-flop circuits $F_1$ to $F_5$ through a multi-operated switch SM having push buttons, for example, a plurality of switches $S_{1-1}$, $S_{1-2}$ . . . $S_{16-1}$ each row group of which can be selectively operated. For example, when the push button corresponding to the dividing number 33 is selected, contacts of the first row switch groups $S_{1-1}$, $S_{1-2}$, $S_{1-3}$, $S_{1-4}$, $S_{1-5}$ are connected, but the others contacts thereof are held opened as shown in FIG. 3. In selecting the push button corresponding to the dividing number 35, the contacts of the second row switch group $S_{2-2}$, $S_{2-3}$, $S_{2-4}$, are connected but the other contacts remain all opened. In the same way, the contacts in any row corresponding to any selected dividing frequency are connected, while the other contacts are held opened.

The operation will be described with reference to an example in which the switch group for the dividing number 33 is selected. The flip-flop circuits $F_1$ to $F_5$ are reset by the output signal generated from the monostable multivibrator $M_1$ through contacts $S_{1-1}$, $S_{1-2}$ . . . . $S_{1-5}$. In this state, the counter indicates the signal "1 0 0 0 0 0" which is a binary number corresponding to 32 in the decimal system. As the flip-flop circuits are connected in counting-down manner, the signal contained therein is reduced by one for every application of a pulse from the generator to the counter, thus passing through 0 to −1 is indicated in complement form, and thus as the signal "1 1 1 1 1 1" in the binary system. At this time, the monostable multivibrator is triggered to reset the counter to 1 0 0 0 0 0, thus finishing one cycle of the counter. The counter includes the states of 32 to 0 in the decimal system, thus constituting a 33-divider circuit. Generally, the initial value of the counter is required to be set to *n*-1 for obtaining the *n*-divider circuit. By dividing the frequency 166.79 Hz from the generator by any one of numbers 33 to 63, the tempo signals respectively corresponding to the frequency 304 to 160 per minute are produced from the output terminal $Q_6$ of the flip-flop circuit $F_6$. When the movable contactor of the switch is connected to the contact S*a*, signals having the frequency 304 to 160 per minute are produced from the output terminal T. Further, when the contactor $S_A$ is connected to the contact, $S_b$ signals from the terminal $Q_6$ are divided in half by the flip-flop circuit $F_7$, whereby tempo signals having the frequency 152 to 80 per minute are produced therefrom. Furthermore, when the contactor is connected to the contact S*c*, signals from the terminal $Q_7$ are further divided in half by the flip-flop circuit $F_8$, and tempo signals having the frequency 76 to 40 are produced therefrom. Thus, 48 kinds of tempo signals having the frequency of 304 to 40 pulses per minute may be obtained with the accuracy of 0.7% error, using multi-operated switch $S_M$ and the switch having contactor $S_A$, contacts S*a*, S*b* and S*c*. In these tempo signals, 304 to 216 pulse-per-minute signals are not required, while 208 to 40 pulse-per-minute signals of 39 kinds are usually applied to actual use. However, tempo signals as actually required are usually those having the frequency 52 to 40. It will be, therefore, appreciated that by setting multi-operated switch SM and selecting any one of switch contacts S*a*, S*b* and S*c*. 39 kinds of tempo signals throughout the frequency of from 208 to 40 per minute may be obtained with an accuracy of 0.7% error.

As mentioned above, the electronic metronome according to the first embodiment of the present invention has many advantages. Thirty-nine kinds of tempos may be obtained by one generator without using many expensive generators. The divider may be miniaturized at a moderate price compared with conventional devices because the divider circuit employed therein divides the frequency into desired tempo signals by selecting the dividing number with the push buttons, while the divider circuit itself had in the conventional metronome to be selected according to desired tempos. Further, a highly reliable metronome without any substantial variation of tempos during time lapse can be made at a low price with high quality and with very great utility.

Figure 4:
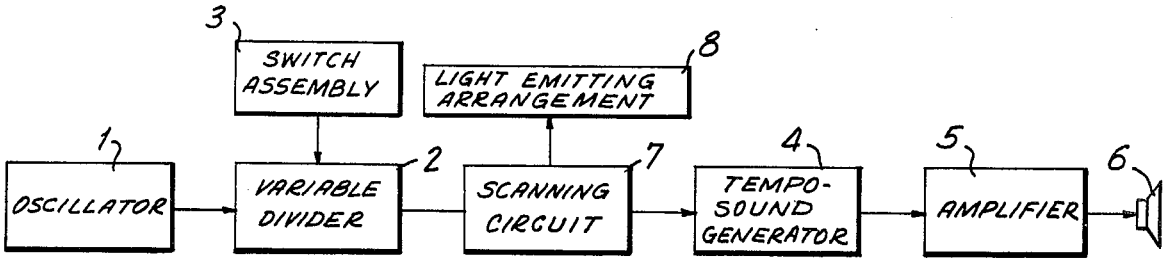
FIG. 4 is a block diagram of another circuit arrangement illustrating an electonic metronome according to the present invention.
Figure 5:
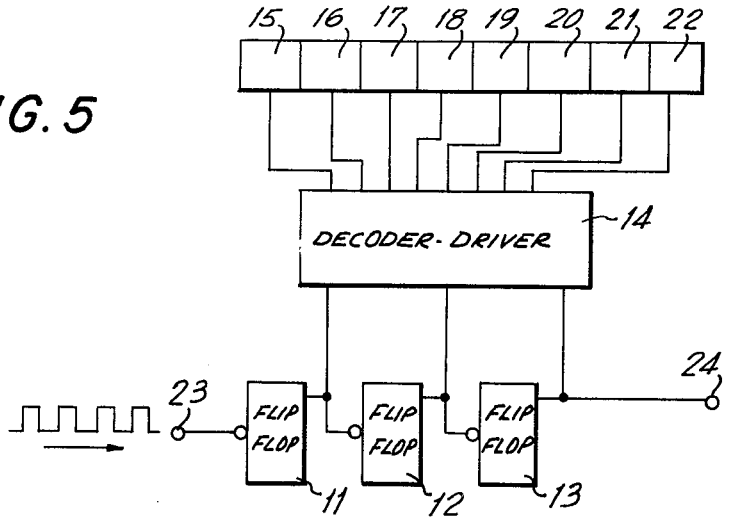
FIG. 5 is a circuit diagram illustrating the main parts the circuit arrangement of FIG. 4.

Referring to FIGS. 4 and 5, there is shown another embodiment of the electronic metronome according to the present invention.

In FIG. 4, the electronic metronome comprises an oscillator 1, the divider 2, the switch 3, a circuit 7 for operating a light-emitting arrangement 8, the circuit 4 for producing a tempo-sound, the amplifier 5, and the loud-speaker 6. The oscillator 1 generates a much higher frequency output than that of the above embodiment illustrated in FIG. 1. The divider 2 has the same construction as that in FIG. 1, so that actual output signals of the divider are much higher in proportion to the frequency of the oscillator 1. The light-emitting arrangement 8 is connected to the circuit 7. The circuit 7 comprises flip-flop circuits 11, 12 and 13 (FIG. 5) constituting a 3-bit binary counter, a decoder-driver 14, and light emitting elements 15 to 22. Clock pulses of the divider 2 are applied to the input terminal 23 of the counter circuit and are counted by the counter. Then, the number counted thereby is taken out to the decoder-driver 14 to successively turn on the light emitting elements, in such a way as the element 16 after the element 15, the element 17 after the element 16, and so on, the turned on number of which is equal to the number mentioned above. As the content of the counter is changed, the light emitting elements 15 to 22 are successively turned on in the form of a flow of a light spot and at the same time tempo signals are produced from the output terminal 24.

Figure 6:
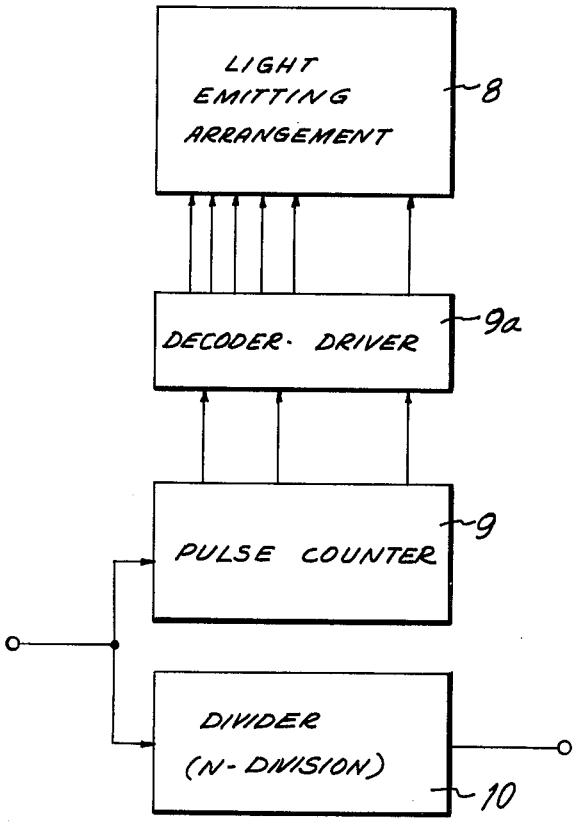
FIG. 6 is a block diagram of a circuit applicable to the electric metronome in FIG. 4 instead of that in FIG. 5 in which complicated scanning is effected.

Further, when the arrangement 8 is not a one-dimensional arrangement but is a more complicated arrangement, a pulse counter 9 and a dividing circuit 10 are separately provided in such a way, as shown in FIG. 6, that the cycle length of the counter 9 is an integral number times as large as the dividing frequency N of the divider circuit 10. The frequency from the generator 1 being multiplied N times of that in the oscillator 1 in FIG. 1, the tempo signals are obtained at the outputs from the divider circuit 10 with the pulse counter 9 also operated, according to which the light emitting arrangement 8 is successively turned on by a decoder-driver 9*a* in synchronism with the generation of the tempo signals.

As mentioned above, the tempo signals are obtained by dividing the clock pulses from the oscillator 1 by means of the divider included in the variable divider 2 and in the scanning circuit 7 (including flip-flop circuits 11 to 13 or the divider 10), and at the same time various tempos are visually displayed as a flow of a light spot which is successively turned on whenever the tempo signal is read out by the decoder. Therefore, many advantages are brought about as follows: the progress of the beats may be visually appreciated instantaneously; even a beginner is able to set tempos with ease; and the same effect as a baton waved by a conductor may be obtained.

Figure 7:
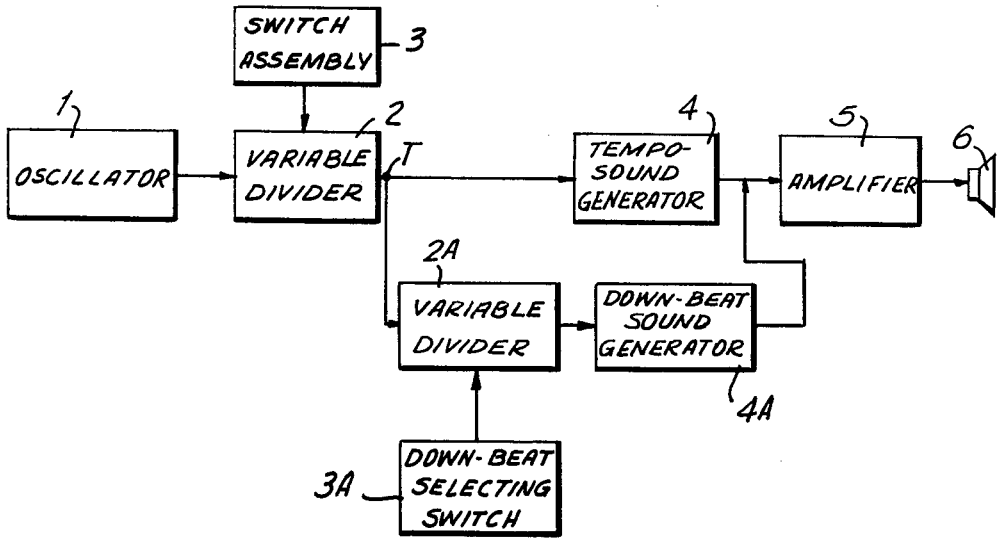
FIG. 7 is another block diagram of a circuit illustrating another electronic metronome according to a further embodiment of the present invention.

In FIG. 7, the electronic metronome comprises the means 1 to 6 which are used for the arrangement of the electronic metronome in the first embodiment, and further comprises a variable divider 2A, a down-beat signal selecting switch 3A and a down-beat sound generator 4A. The tempo signals T generated from the variable dividing circuit 2 are further divided by the variable divider 2A, which is controlled by the down-beat signal selecting switch 3A for supplying down-beat sound generator 4A. The down-beat sound signal generated from the output terminal of the circuit 4A is applied to the input terminal of the amplifier 5 in mixture with the tempo-sound signals produced from the tempo-sound generator 4. Therefore, the accentuated tempo sounds are obtained from the loud-speaker 6 with not only the normal tempo sound but also with a down-beat sound.

Figure 8:
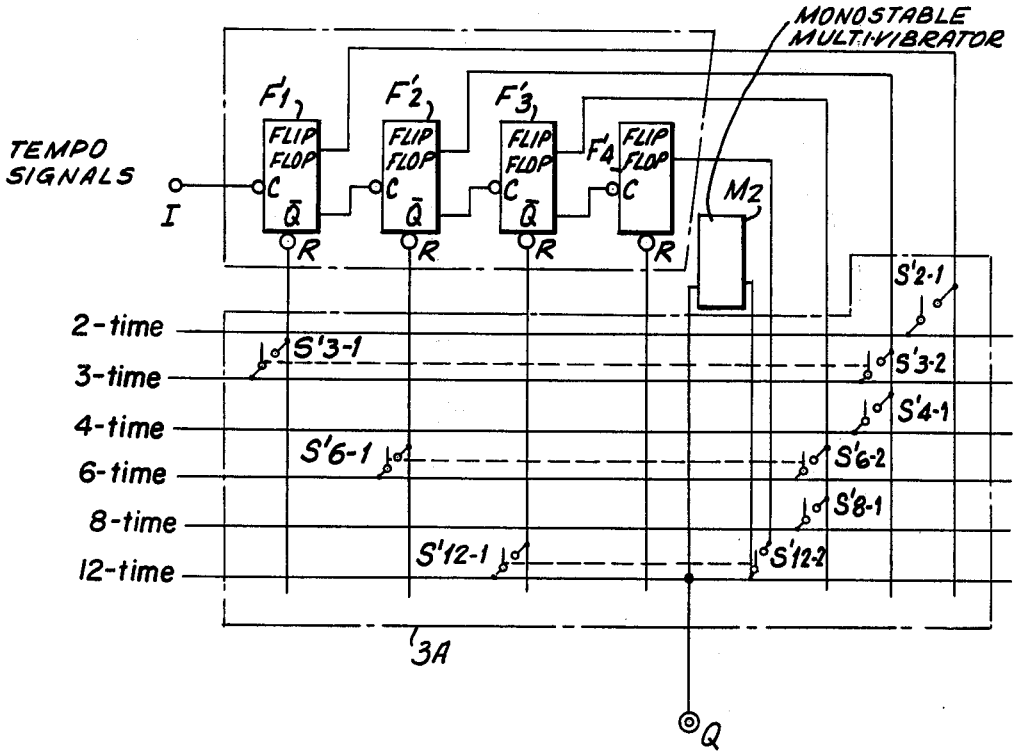
FIG. 8 is a circuit diagram illustrating the main parts of the electronic metronome shown in FIG. 7.

Next, the circuit diagram of the above-mentioned variable divider 2A will be described in connection with FIG. 8. The variable divider 2A comprises flip-flop circuits $F'_1$ – $F'_4$ connected in four-stage cascaded configuration and a down-beat signal selecting switch 3A. The flip flop circuits $F'_1$, $F'_2$, $F'_3$, $F'_4$ constitute a counting-down counter in which $S'm.n$($m$=2, 3, 4, 6, 8, 12, $n$=1, 2) indicates the contact of the push button switches. When a push button switch for a double time is pushed, only the contact $S'_{2-1}$ is closed with the other contacts being held opened. When a push button switch for a triple time is pushed, only two contacts $S'_{3.1}$ and $S'_{3.2}$ are closed with the others being opened. Other push button switches are constructed in a similar manner to the above-mentioned ones so that when, generally, the push button switch for $m$ time is pushed, only the contact $S'm.n$ ($n$=1, 2) is closed but the other contacts are held opened. A monostable multivibrator $M_2$ serves to reshape the wave form of the outputs from the counter to reset each flip-flop circuit, and serves to produce the down-beat signals. The pulse of the tempo T signals applied to an input terminal I is divided in half by the flip-flop circuit $F'_1$. In the case of the double time, the output from the flip-flop circuit $F'_1$ is applied to the monostable multivibrator $M_2$, so that the down-beat signal of the double time may be obtained from an output terminal Q. In the case of 4 time or 8 time, flip-flop circuit $F'_2$ or a combination of flip-flop circuits $F'_2$ and $F'_3$ also serves to divide the signals by a quarter or one-eighth to obtain the down-beat signals of the respective times as mentioned above.

Moreover, in the case of the triple time, a triple counter such as a 2- 1- 0- 2- 1- 0 . . . . counting mode is constituted by setting the initial value of the count-down counter comprising the flip-flop circuits $F'_1$, $F'_2$ to 2, whereby the down-beat signals of the triple time can be generated from an output terminal Q.

Similarly, the down-beat signal of the 6 time is obtained by setting the initial value of the counting-down counter comprising the flip-flop circuits $F'_1$, $F'_2$, $F'_3$ to 5 and, further, the down-beat signal of the 12 time obtained by setting the initial value of the counting-down counter comprising the flip-flop circuits $F'_1$ to $F'_4$ to 11. The output signal from the variable divider 2A is converted to an audible signal as desired by means of the down-beat sound generator 4A for producing the down-beat signals.

As mentioned above, the down-beat signal generator of high reliability is obtained at low cost with a simple construction in which only the variable divider comprising flip-flop circuits and switches is employed. Additionally, down-beat sounds of 6, 8 are 12 times which require a lot of and complex dividing are stabily obtained with ease.

Figure 9:
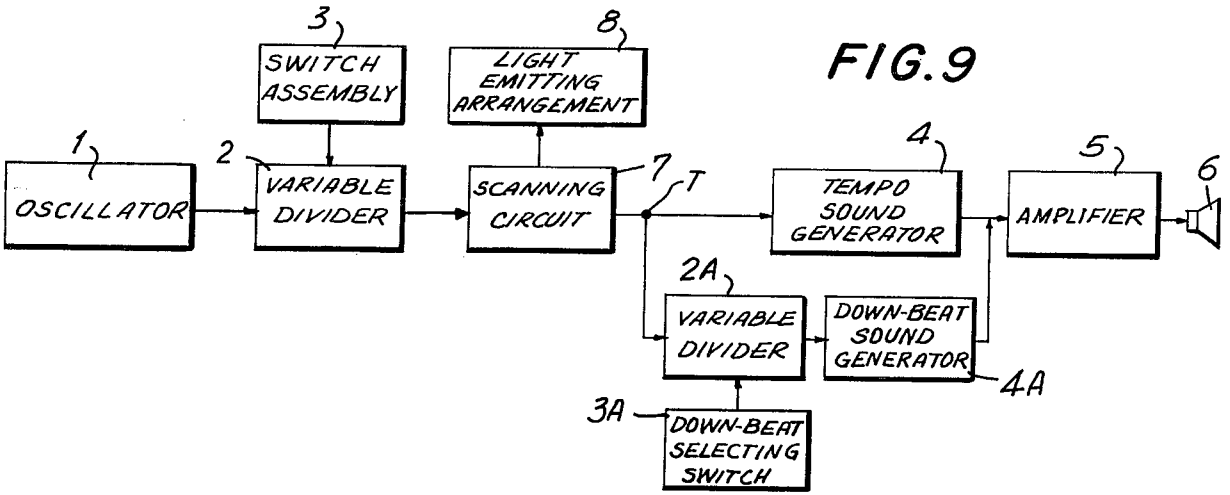
FIG. 9 is another block diagram of a circuit illustrating a fourth embodiment of the present invention.

Referring to FIG. 9, the illustrated circuit arrangement is constructed by combining the embodiment shown in FIG. 4 with the embodiment shown in FIG. 7. Therefore, a description of the same elements shown in FIGS. 4 and 7 is omitted. The circuit arrangement as shown in FIG. 9 permits the normal tempo signals with the down-beat signals to be generated as well as the luminous display to be effected. This further enhances the function as a metronome with the expectation of musical effects which are not found in conventional metronomes.

Figure 10:
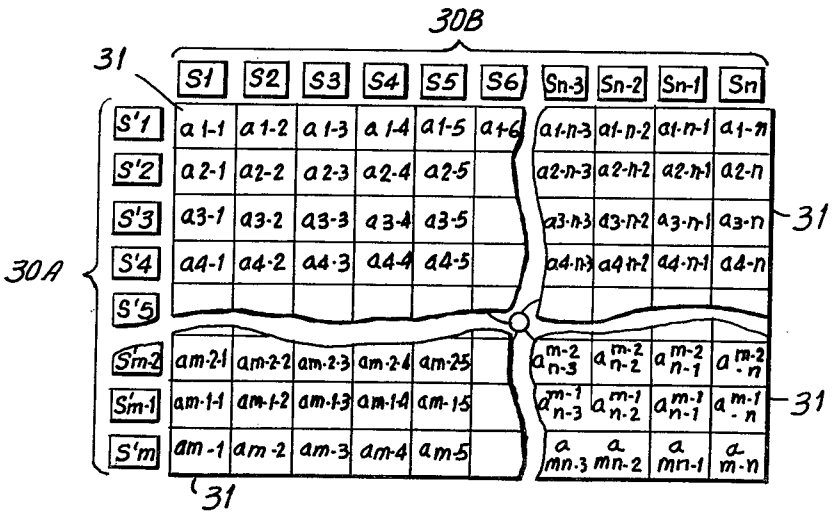
FIG. 10 illustrates a switch for selecting tempos provided in an electronic metronome of the invention.

In FIG. 10, there is shown a mechanical construction of the switch assembly 3 for selecting tempos. Two sets of switch button groups 30A and 30B are disposed on a switch board in horizontal and vertical directions, respectively. On the plane of a curved surface constituted by the switch groups, there is disposed a plate 31 on which marks are arranged in matrix form ($a_{1.1}$, $a_{1.2}$ . . . $a_{m-1.n-1}$, $a_{n.n}$ in FIG. 10) which indicate the combination of the circuit arrangement selected by any desired operation of the two switches. It will be understood that the switch is constructed in a two dimentional arrangement.

With this arrangement, in order to obtain the circuit state $a_{3.4}$ as shown in FIG. 10, for instance, one switch button $S'_3$ in the vertical switch button group 30A and the other switch button $S_4$ in the horizontal switch group 30B may be pushed. Similarly, the circuit state $a_{m.n}$ may be obtained by pushing one horizontal switch button $S'm$ and one vertical switch button Sn. The vertical switch button group 30A corresponds to the group of switch $S_{1-1}$ to $S_{16-1}$ in FIG. 3 while the horizontal switch button group 30B corresponds to the switch which has the contactor $S_A$ and contacts $Sa$ to $Sc$. Therefore, in the case of using the mechanical construction in FIG. 10 for the embodiment of FIG. 3, the number $m$ of push buttons in the button group 30A is 16 and the number $n$ of the push buttons in the button group 30B in 3.

As mentioned above, two sets of push button switches are disposed on the switch board and, on the upper surface, there is disposed the plate having the sections arranged in matrix form for displaying the combination of the circuit arrangements selected by two desired push button switches, so that the complicated circuit-switching operations are rendered simple. Even those who are inexperienced in the operation of machinery can operate the device with ease.

Figure 11:
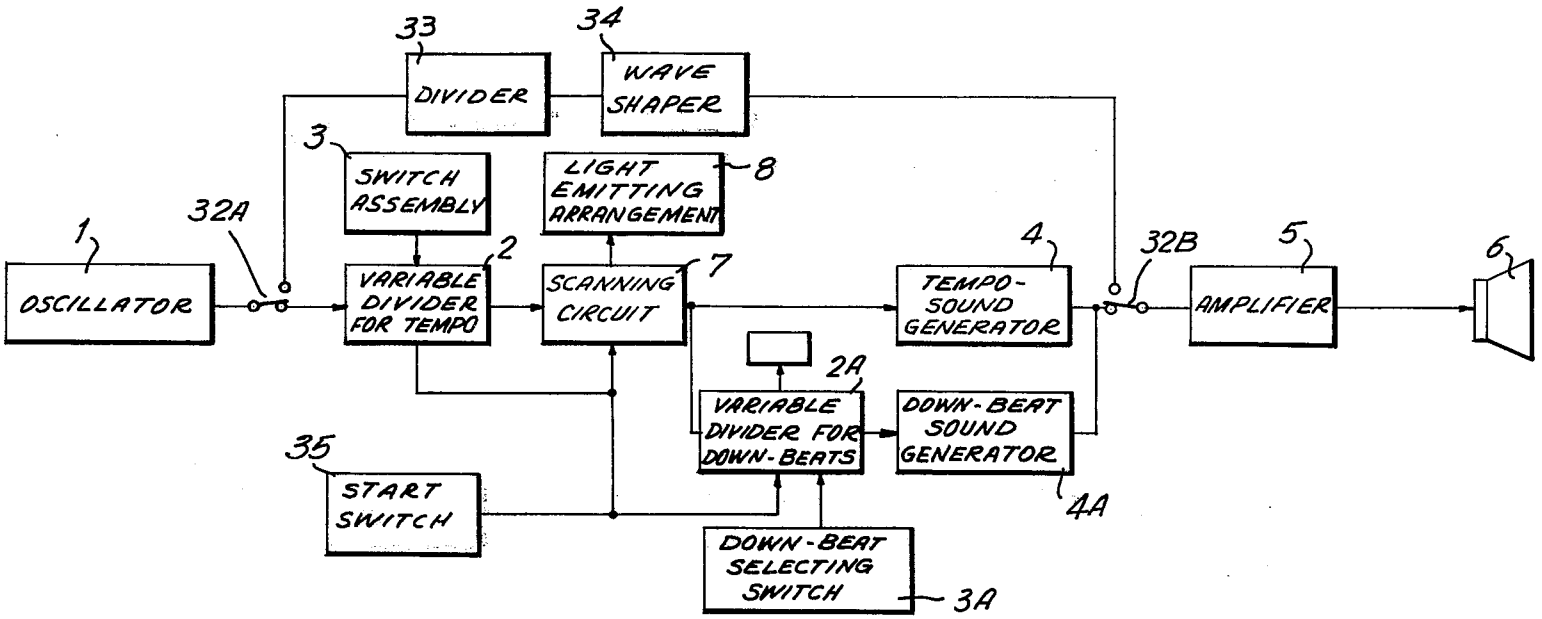
FIG. 11 is another block diagram illustrating another electronic metronomic constructed according to the present invention.

In FIG. 11, there is shown another embodiment wherein an output signal generated from the oscillator 1 is also applied to a tuning divider 33 and a wave shaper 34, which serves to produce a signal for tuning by means of dipolar double-thrown switches 32A and 32B. The oscillator 1 in this embodiment generates a high frequency output as high as 3520 Hz. For instance, the tuning signal having a frequency of an integral time of 440 Hz is produced, which is in turn altered to an audible sound. The audible sound is generated from the loud-speaker 6 to tune musical instruments, thus providing the electronic metronome with a tuner.

Further, it is possible for many unrehearsed members to start a concert all together in accordance with the first appearing tempo, provided that the resetting and starting operation are effected by connecting a start switch 35 of a push button type with the reset terminals of the flip-flop circuits provided in the dividers 2 and 2A and the circuit 7 for effecting the luminous display.

Figure 12:
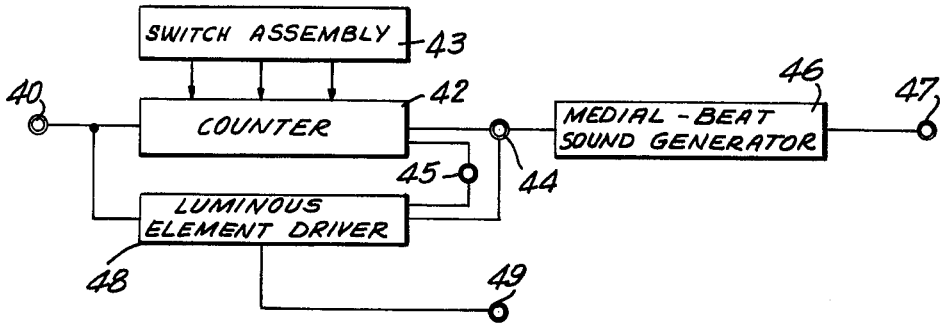
FIG. 12 is a partial block diagram of a further electronic metronome according to the present invention.

In FIG. 12, there is shown another block diagram of an electronic metronome comprising an input terminal 40 to which tempo signals T are applied, a third variable divider or counter 42 including flip-flop circuits, a switch assembly 43, an output terminal 44 for medial-beat signals, an output terminal 45 for down-beat signals, a medial-beat sound generator 46, an output terminal 47 for medial-beat sound signals, a circuit 48 for operating luminous elements, and an output terminal 49 for luminous element operating signals.

The divided ratio of the counter 42 is determined at a predetermined value by selecting a switch corresponding to a desired time in the switch assembly 43, so that medial-beat signals are obtained at the terminal 44 connected to the output of the counter 42. The medial-beat sound generator 46 serves to convert the above-mentioned medial-beat signals into suitable audible frequency signals appearing at the terminal 47 as the medial-beat sound signals. The medial-beat sound signal is then applied to the loud-speaker 6 through the amplifier 5 which are shown in FIG. 7 to obtain a medial-beat sound. In this embodiment partially illustrated in FIG. 12, the whole block diagram is similar to that in FIG. 7. The variable divider 2A and the down-beat selecting switch 3A are respectively replaced by the counter 42 and the switch assembly 43 which include a more complicated construction both for a down-beat signal and for a medial-beat signal, as will be described later. The output terminal 45 is connected to the down-beat sound generator 4A of FIG. 7, and the output terminal 49 is connected to luminous elements. Further, the tempo signal, down-beat signal and medial-beat signal and medial-beat signal are respectively applied to the luminous element operating circuit 48 to produce the luminous element operating signals at the terminal 49. As a result, several kinds of beats are respectively displayed in various optical patterns of the luminous elements.

Figure 13:
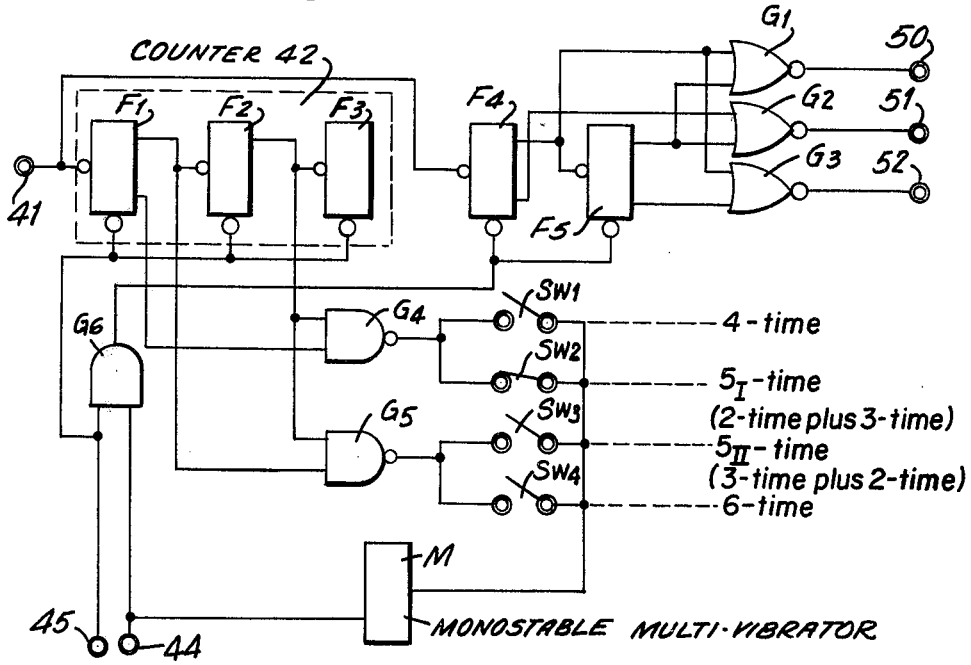
FIG. 13 is a logic diagram illustrating a variable counter circuit with a decoder selecter for selectively driving the units of a luminous element applicable to the metronome partially shown in FIG. 12 in accordance with the invention.

Referring to FIG. 13, there is shown a circuit diagram of the variable divider connected to the luminous element operating circuit 48 wherein flip-flop circuits $F_1$ to $F_3$ are employed as a counter 42. The counter 42 is reset by the down-beat signals obtained by counting the tempo, the frequency of which is equal to the desired time. Down-beat selecting switches and the logic circuit for obtaining the desired time are not shown in FIG. 13. A group of switches $SW_1$ to $SW_4$ are disposed in the switch assembly 43 and are used to obtain the medial beat. The operation of the switch assembly is effected in such a way that when a push button switch for $5_l$ time is, for example, pushed, only the contact thereof is closed with the other contacts being held opened. A monostable multivibrator M serves to reshape the wave form of the medial-beat signal. The circuit 48 further includes flip-flop circuits $F_4$ and $F_5$. The counter 42 for counting the tempo signals is constituted to be reset by the down-beat signals or medial-beat signals at the predetermined value of the musical time.

The operation of the electronic metronome according to this embodiment will next be described. When the tempo signal pulses are applied to the input terminal 41 with the desired time selected by the switch assembly 43, the frequency of the pulse is divided by the flip-flop circuits $F_1$ to $F_3$ to produce the down-beat signals in accordance with the selected musical time. Further, the medial-beat signal is obtained from the monostable multivibrator M with the wave form thereof reshaped thereby so as to be used as a signal for producing the medial-beat sound as well as a signal for resetting the luminous element operating circuit 48.

In the case of $5_l$ time (double time plus triple time), for every application of five tempo signal pulses to the input terminal 41 one down-beat signal is obtained by the flip-flop circuits $F_1$ to $F_3$ constituting a 5 counter in this case which is not shown. When the content of the counter 42 becomes 2 in the decimal system, the output signal of a medial-time selecting gate circuit $G_4$ is 0 in binary. As this gate is a NAND-gate the signal 1 is applied to the monostable multivibrator M through the switch $SW_2$, so that the medial-beat signal having a reshaped wave form is obtained at the output terminal 44. The medial-beat signal serves to produce a medial-beat sound as will be described later referring to FIG. 14. Flip-flop circuits $F_4$ and $F_5$ also receive the tempo signal pulses, thereby effecting a scanning 1 signal on output terminals 50, 51 and 52. The medial-beat signal is fed through an AND-gate $G_6$ to the flip-flop circuits $F_4$ and $F_5$ to reset the content of flip-flop circuits $F_4$ and $F_5$. In this way, the scanning operation at the output terminal 50, 51 and 52 is reset, signal 1 appearing only at the output terminal 50. As a result, the scanning device of the luminous elements (not shown in FIG. 13) which is connected to the output terminals 50, 51 and 52 is reset to the first luminous element which corresponds to the output terminal 50 at the same time, the medial-beat sound is produced from a loud-speaker through the medial-beat sound generator and amplifier.

The flip-flop circuits $F_4$ and $F_5$ are also reset by a down-beat signal which is fed from the down-beat output terminal 45 through the gate $G_6$. Thus, the luminous elements are driven successively in a scanning sequence of 1, 2, 1, 2, 3, 1, 2, 1, 2, 3 - - - . When 6-time is selected with switching on the switch $Sw_4$ and a 6-time switch in the down-beat selecting switches, the scanning changes to 1, 2, 3, 1, 2, 3, 1, 2, 3, - - - .

Figure 14:
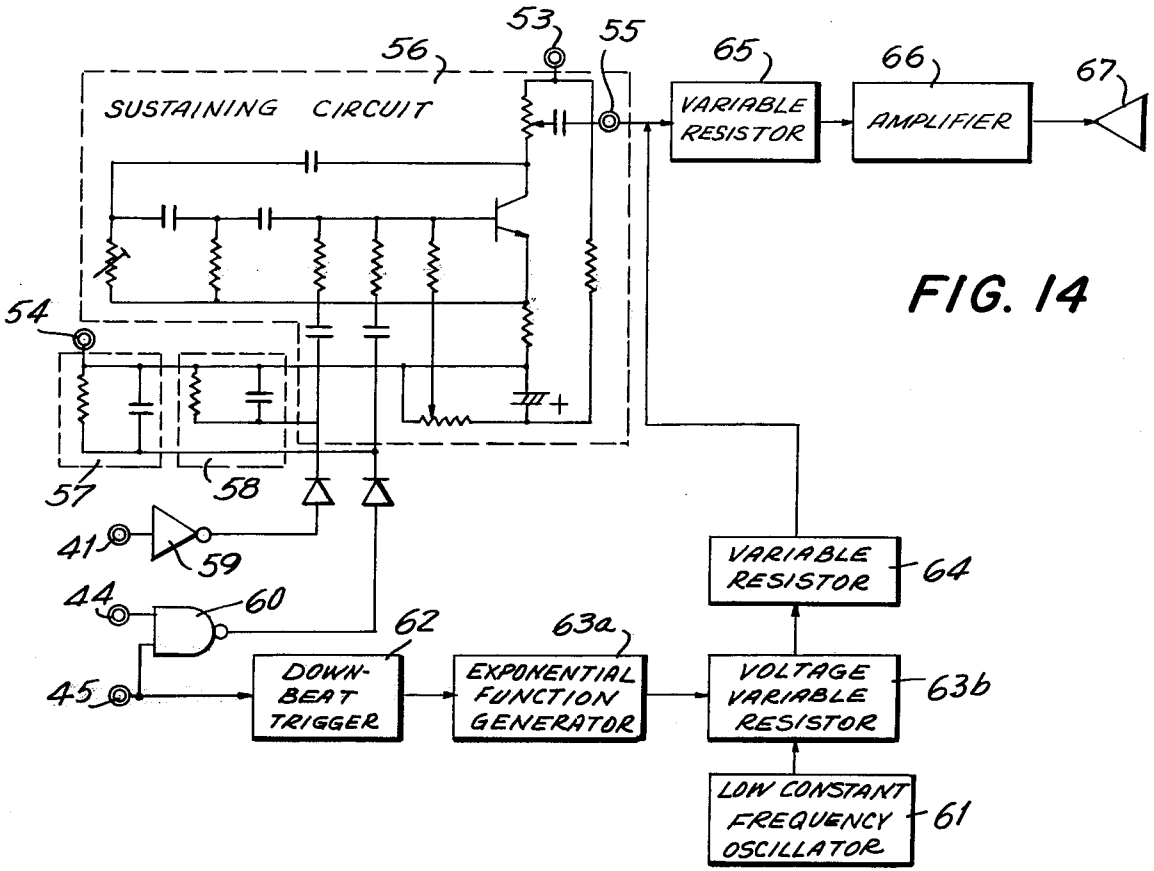
FIG. 14 is a circuit diagram illustrating a medial beat sound generator applicable to the metronome partially shown in FIG. 12 in accordance with the invention.

Referring next to FIG. 14, there is shown the circuit diagram of the medial-beat sound generator wherein there is included a sustaining circuit 56 of phase type which produces the up-beat signals or medial-beat signals at a terminal 55. The amplitude and decay time of the up-beat signal differ from those of the medial-beat signal depending upon the generating condition of the circuit.

The oscillation conditions of the circuit 56 in the case where only the up-beat signal is applied thereto is different from those in the case where the up-beat and medial-beat signal or the up-beat and down-beat signal are applied thereto since the time constant is different because of different capacity of capacitors in the exponential function generators 57 and 58. The generator 57 is energized when a down-beat or medial-beat signal is applied from the input terminal 45 which receives down-beat signals or terminal 44 which receives medial-beat signals, through a NAND gate 60, while the other exponential function generator 58 is energized at every tempo signal which is applied from the input terminal 41 which receives tempo signals, by way of an inverter 59. A terminal 53 is connected to the power source (not shown), an terminal 54 being connected to ground. As a result, either the up-beat sound signal or the medial-beat sound signal having the different amplitude and decay times are produced from the terminal 55.

Further, the down-beat sound signal is produced by applying the signal having an audible frequency from a low constant frequency generator 61 to a voltage variable resistor **63*b* and by triggering the latter by means of the signal passing through a down-beat triggering circuit 62 and an exponential function generator 63*a*.**

When the down-beat sound signal is adjusted to a suitable level by a first variable resistor 64, and the up-beat sound signal and the medial-beat sound signal are adjusted to suitable levels by a second variable resistor 65 for the application to a loud-speaker 67 through an amplifier 66, each sound is discriminately audible in mixed relationship.

The amplitudes and decay times of the up-beat, medial-beat and down-beat sound signals at the terminal of the loud-speaker 67 may be 10Vp-p · 10ms, 11Vp-p · 20ms, 6Vp-p · 500 ms, respectively. The frequencies of the up-beat sound signal and the medial-beat sound signal are 2880Hz, respectively, while that of the down-beat sound signal is 3521 Hz. Therefore, the up-beat sound and the medial-beat sound are distinguished from each other by an auditory sense because of their respective different decay times. The down-beat sound is, on the other hand, distinguished from other sound because of its different frequency and decay times. It is to be noted that the up-beat sound and medial-beat sound are designated as a clave sound, respectively, while the down-beat sound is designated as a chime sound.

Similarly, in the case of 6 time, a 6-bit counter is constituted. When the content of the counter becomes 3 in the decimal system, a medial-beat signal having the wave form reshaped by the output from the monostable multivibrator M can be obtained. The above-mentioned signal is also used for operating the luminous elements and sounding the beat thereof.

As mentioned above, the electronic metronome according to this embodiment brings about many advantages as follows: an electronic metronome of high stability in which various accurate tempos are generated may be obtained at a moderate price by using a very stable frequency generator with a tuning fork or quartz oscillator, the signals from which are in turn divided at a desired ratio by a variable divider; a musically excellent metronome having no tempo variation for a long time can be obtained with mass production techniques with ease and at inexpensive cost, since the electronic metronome is responsive to no disturbance such as a temperature, humidity, exterior mechanical oscillation and change of position; it renders the electronic metronome very convenient such that the light flows synchronously to the tempo and time visually acts as like as a conductor's baton; the down-beat sound having a relatively large frequency is stably and assuredly produced by further dividing tempo signals at the desired ratio; the medial-beat sound signals can be obtained by a simple variable divider comprising flip-flop circuits constituting a counter and a switch assembly; the composite time in which two kinds of 5 times are mixed is audibly and visually shown by acoustically and optically displaying the medial-beat sound signals; and the electronic metronome is made perfect from a musical viewpoint when the luminous display of tact is effected in synchronism with the sound of a down beat, thus insuring the provision of an electronic metronome with excellent effect and utility.

Figure 15:
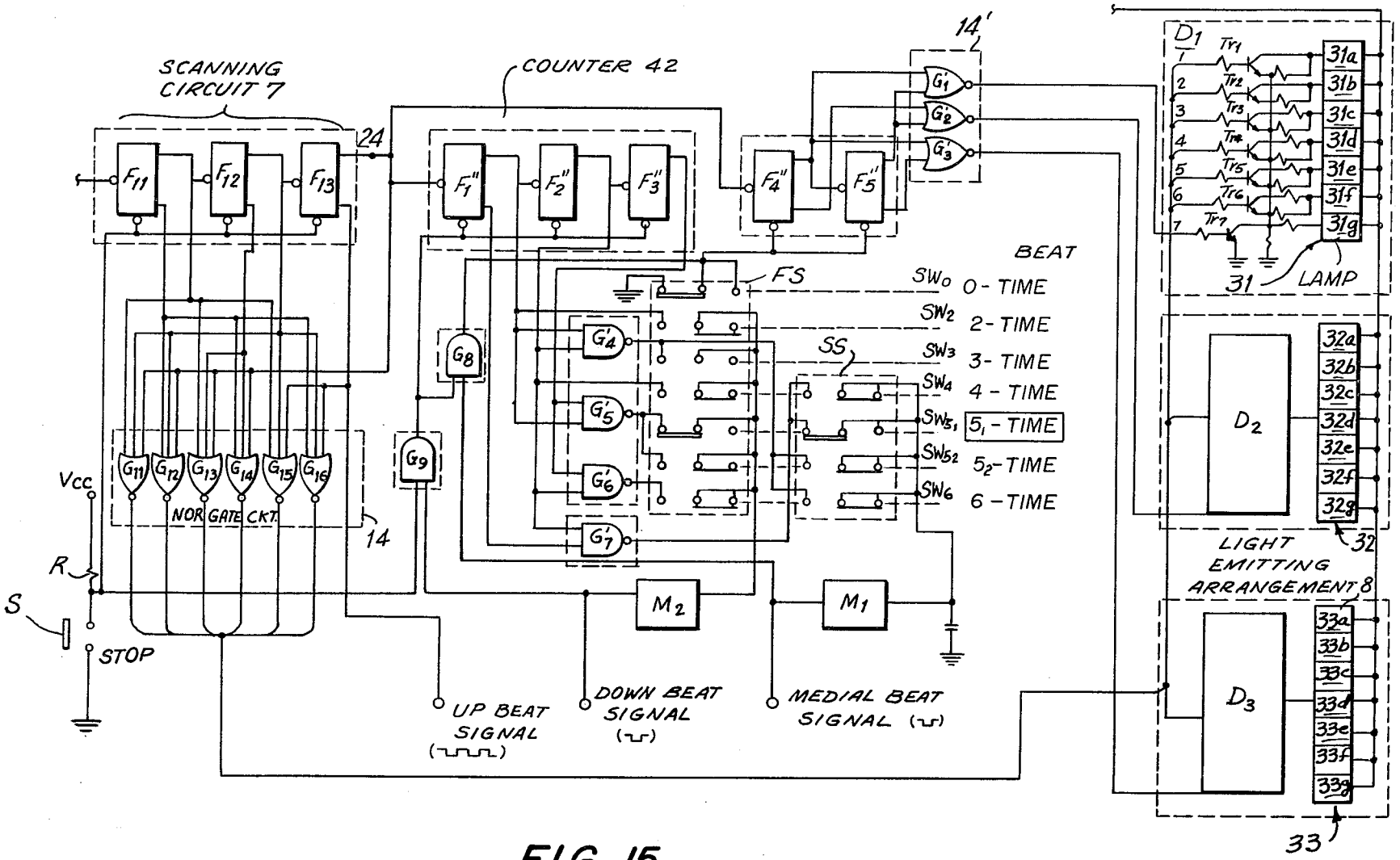
FIG. 15 is a circuit diagram of an electronic metronome having a display in the form of a flow of light applicable to the metronome partially shown in FIG. 12.

FIG. 15 illustrates a circuit whereby a desired tempo is displayed by a light emitting arrangement as a flow of light and whereby beat signals of a desired time are selected. More particularly, the circuit in FIG. 15 includes a scanning circuit 7, a counter 42, a decoder selecter consisting of a set of NOR gates $G'_1$ to $G'_3$ and flip-flops $F''_4$ and $F''_5$, a switching assembly $SW_0$ to $SW_6$ and light emitting arrangement 8. The scanning circuit 7 comprises flip-flop circuits $F_{11}$ to $F_{13}$ constituting a 3-bit binary counter, a plurality of NOR gates 14, and drivers $D_1$ and $D_3$ for light emitting arrangement 8 which has light emitting elements (lamps).

The NOR gate circuit 14 includes a plurality of NOR gates G11–G16 respectively coupled to flip-flops F11–F13.

In addition to the aforesaid elements, there are provided multivibrators M1 and M2 respectively connected to gate G8 and G9. Gate G8 has a second input, the output of gate G9 whose second input is connected to a stabilized D.C. voltage source $V_{cc}$ through a resistor, common lines with that to the gate $G_9$ being connected to each resetting terminal of flip-flop $F_{11}$, $F_{12}$ or $F_{13}$ and to a push button STOP the other terminal of which is connected to ground.

Counter 42 includes flip-flops $F''_1$ to $F''_3$, each of the resetting terminals of which is connected to the output terminal of gate G9. The outputs of flip-flops $F''_1$ to $F''_3$ are generally fed to gates $G'_4$ to $G'_7$, the outputs of which are transmitted to various switches $S_{u2}$–$S_{u6}$.

As will be seen the outputs of NOR gate circuit 14 are fed to decoder drivers $D_1$ to $D_3$. The details of drive D1 are shown. It is seen that this driver by way of example comprises a plurality of transistors $Tr_1$ to $Tr_7$ as well as a plurality of resistors connected in series with the bases and collectors thereof. It will also be noted that the collectors are connected to the respective lamps constituting parts of the light emitting arrangement 8.

In FIG. 15, an output 24 of the flip-flop F13 is connected to the counter 42 which operates as a variable counter with the aid of the down-beat and medial beat selecting switches $SW_0$ to $SW_6$. The drivers $D_1$ to $D_3$ for energizing light emitting elements constituted, for example, by seven or eight lamps. LAMP, are controlled by the NOR gate circuits 14 and the NOR gates $G'_1$ to $G'_3$. Such elements are in alignment with each other as a light emitting arrangement 8, the respective elements of which are connected to drivers D1 to D3 through the corresponding NOR gate circuit 14 including NOR gates G11 to G16, respectively. When a predetermined frequency of tempo signal enters into the scanning circuit 7, an output from the flip-flop circuits is applied to one of NOR gate circuits G11-G16. The output signal from the NOR gate circuits 14 is then applied to the drivers D1 to 2.

When, for example, flip-flop circuits F11 to F13 are reset to 0 by pushing STOP button, the output signal thereof is applied to NOR gates 14, making NOR gate $G_{11}$ have 1 level output and the output signal thereof is applied to each transistor $Tr_1$ in the drivers $D_1$ to $D_3$, while other transistors $Tr_2$ to $Tr_6$ remain to receive 0 level signals. On the other hand, flip-flops $F''_4$ and $F''_5$ receive output pulses of flip-flop circuit $F_{13}$, which are synchronous to the beat signals, and make the NOR gates $G'_1$ to $G'_3$ generate outputs in a way that NOR gate $G'_1$ generates a 1 level output after the reset, then, NOR gate $G'_2$ generates 1 level output when the flip-flop $F''_4$ receives a 1 level input from flip-flop circuit $F_{13}$, and NOR gate $G'_3$ generates a 1 level output when the flip-flop $F''_4$ receives the next 1 level input. Thus, 1 level output signals appear at NOR gate $G'_1$, $G'_2$ or $G'_3$ successively. Therefore, the transistor $Tr_7$ of the driver $D_1$ receives a 1 level signal from NOR gate $G_1$. Accordingly, the lamp corresponding to the transistor $Tr_1$ of the driver $D_1$ is turned on at full brightness, while the other lamps in the first unit of light emitting arrangement 8 are turned on at half brightness because of resistors connected in series to the lamps. The first input pulse-to flip-flop circuit $F_{11}$ after the reset makes the NOR gate $G_{12}$ generate a 1 level output which is fed to each transistor $Tr_2$ in the drivers $D_1$ to $D_3$. The second lamp which corresponds to the transistor $Tr_2$ of the driver $D_1$ is turned on at full brightness in turn with the first lamp. All the lamps corresponding to the drivers $D_2$ and $D_3$ still remain turned off. Thus, at every input pulse to the flip-flop circuit $F_{11}$, the lamps in the first unit of the light emitting arrangement 8 are successively turned on at full brightness, constituting a flow of light. At the fourth input pulse to the flip-flop circuit $F_{11}$ after the reset, a 1 level output is generated at the output terminal 24 and the NOR gate $G_2$ has a 1 level output as described above. Accordingly, the lamps in the first unit are turned off and those in the second unit are turned on in the same manner as the first unit. This is the second time of beat. The third unit lamps are turned on during the third time of beat. Down-beat and medial-beat selecting is similar to that in FIG. 13 and therefore detail is omitted here, but it is understandable that the lighting is reset to the first unit of light emitting arrangement at every down-beat or medial-beat signal which resets the flip-flops $F''_4$ and $F''_5$. As a result, each light emitting arrangement 8 uses its lamps to display tempo in a flow of light acting a movement of time pass in one beat which is similar to a pass movement of a conductor's baton during one beat.

As mentioned above, to the variable divider is connected the scanning circuit including flip-flop circuits F11–F13. The light emitting arrangements with their plurality of lamps are connected to the above-mentioned scanning circuit through a decoder driver. This permits the scanning circuit to effect a light emitting display as a flow of light in connection with the light emitting arrangements. With a selection of desired time, for instance, $5_1$ time (donw-up-medial-up-up), the light emitting arrangement 8 is turned on successively in a sequence of the first, the second, the first, the second, the first unit, accompanying light flows in each unit.

It is to be noted that local light flow within a light emitting unit, which corresponds to one tempo, acts as a passing movement of a conductor's baton in one tempo.

With respect to the utilization of switches SWn, these switches SWn are constituted a group of first switches FS which correspond to 0 to 6 times and a group of second switches which correspond to 4 to 6 times, these including a medial beat signal or sound. The first switches and the second switches are adapted to interlock. For example, the pushing ON of the 4 time selecting switch SW4 permits the corresponding one of the second switches to close. That is to say, the pushing ON of the selecting switches SW4, 5, 6 having a medial beat signal, such as the 4, 5, 6 abic times, permits corresponding SW4, 5, 6 of the second switches to close automatically.

with respect to the decoder driver circuits, the decoder driver circuits for illuminating the lamps comprise, as noted above, the drivers D1 to D3 including a group of transistor circuits Trn, the first decoder 14 including NOR gate circuits G11–G16, and the second decoder 14 including NOR gate circuits $G_1$–$G_3$.

Also as noted above, each of the drivers D1 to D3 includes a group of transistor circuits Tr1 to Tr7 to which are connected the light emitting lamps. The first decoder 14 is for decoding the output signal from the scanning circuit 7 having flip-flop circuits F11, F12 and F13. The output signals from the scanning circuit 7 are applied to the input terminals of NOR gate circuits G11 to G16 and the output signals from the gate circuits G11 to G16 are then adapted to be applied to the base of the transistors Tr1 to Tr6 in the decoder D1.

The second decoder $14^1$ includes the three NOR gate circuits G1 to G3 and is adapted for decoding the output signals from the flip-flop circuits F4 and F5. Simultaneously the output signals from the flip-flop circuits F4 and F5 are applied to the input terminals of the NOR gate circuits G1 to G3 are then applied to the base of the transistor Tr7.

Referring more particularly to the decoder D1, the above mentioned transistors Tr1 to Tr6 have the same characteristics while the transistor Tr7 is different. The collectors of the transistor circuits Tr1 to Tr6 are connected to the lamps 31*a* to 31*f*, with the emitters thereof being connected to the collector of the transistor Tr7.

In operation the group of lamps 31 are adapted to be displayed to represent down beat and medial beat sounds while lamps 32 and 33 are displayed to represent up beat sounds. When a lighting signal is applied to the lamps 31, the lamps 31*a* to 31*g* effect a lighting operation all at once. In this case, the lamps become dark gradually starting from lamp 31*a* proceeding to lamp 31*f* thereby displaying the time on one beat of down beat and medial beat sounds as a flow of light.

In connection with the decoder D and the first and second decoders 14 and $14^1$, the signal generated at the gate $G_1$ of the second decoder $14^1$ is applied to the base of transistor Tr7 for priming the lamps. The operation of transistor Tr7 permits the other transistors Tr1 to Tr6 to work and to illuminate a group of lamps 31*a* to 31*f* at one and the same time.

Since the output signal from the NOR gate circuit G11 is applied to the corresponding base terminal of transistor Tr1 the transistor Tr1 is driven in such a manner that the lamp 31*a* is especially effected to be illuminated brightly. Simultaneously the output signals from the NOR gate circuits G12 to G16 are respectively applied to the transistors Tr2 to Tr6 thereby to drive the same. As a result, the lamps 31*a* to 31*f* are gradually illuminated to form a display as a flow of light. The lighting time of the lamps corresponds to one beat.

With respect to the switch resistor and voltage source Vcc, the voltage source Vcc is adapted for appling signal level 1 (having a certain voltage value), through resistor R to the input terminal of AND gate circuit G9 and further to the resetting terminal of the scanning circuit 7 having the three flip-flop circuits F11 to F13. When applied to them, all the flip-flop circuits F11 to F13 and F1 to F5 are operated. The group of lamps 31 to 33 are energized by driving the flip-flop circuits to display thereby a predetermined lighting selected by a selecting switch SW. The resistor R maintains the voltage value of Vcc at signal level 1.

The switch 5, when in ON condition, resets all the flip-flop circuits and the group of lamps 31 are maintained in the original state, that is to say, the lamp 31*a* is the brightest and the lamps darken from 31*a* to 31*f* in turn. The switch 5 serves as a resetting button for starting the lighting of the lamps. The moment that the switch 5 is turned to ON, the voltage source V*cc* is connected to ground through the resistor R. As a result, the signal level of 1 is applied to the input terminal of the AND gate G9 and the resetting terminal of the flip-flop circuits F11 and F13 is changed to the signal level 0. This resets all the flip-flop circuits F1 to F5 and also F11 to F13. The above-mentioned resistor R, further has the function of preventing the current of voltage source Vcc from rising to an excessive value.

What is claimed is:

1. An electronic metronome comprising an oscillator for producing a signal of predetermined frequency, a first variable divider connected to said oscillator for variably dividing the frequency of said signal to a lower frequency, tempo selecting means for selecting the frequency of an output signal from said first variable divider, light emitting elements, a scanning circuit connecting to said first variable divider for energizing said light emitting elements in succession in response to the output signal generated by said tempo selecting means thereby to display a tempo in a flow of light, said scanning circuit generating at an output terminal thereof a tempo signal to be obtained, a tempo-sound generator connected to said scanning circuit and responsive to said tempo signal for generating a tempo-sound signal, a second variable divider connected to said scanning circuit for variably and further dividing the frequency of the signal obtained thereby to a lower frequency, down-beat selecting means for selecting the frequency of an output signal from said second variable divider to be equal to that of a down-beat sound to be obtained, a down-beat sound generator connected to said second variable divider and responsive thereto for generating said down-beat sound, and means for audibly displaying said tempo-sound obtained by said tempo-sound generator and said down-beat sound obtained by said down-beat sound generator to generate a regularly accentuated tempo-sound.

2. An electronic metronome comprising an oscillator for producing a signal of predetermined frequency, a first variable divider connected to said oscillator for variably dividing the frequency of said signal to a lower frequency, tempo selecting means for selecting the frequency of an output signal from said variable divider to be equal to that of a tempo-sound to be obtained, a tempo-sound generator connected to said divider and responsive thereto for generating said tempo-sound, a second variable divider connected to said first variable divider for variably and further dividing the frequency of the signal obtained thereby to a lower frequency, down-beat selecting means for selecting the frequency of an output signal from said second variable divider to be equal to that of a down-beat sound to be obtained, a down-beat sound generator connected to said second variable divider and responsive thereto for generating said down-beat sound, a third variable divider connected to said first variable divider for variably and further dividing the frequency of the signal obtained thereby to a lower frequency, medial-beat selecting means for selecting the frequency of an output signal from said first variable divider to be equal to that of a medial-beat sound to be obtained, a medial-beat sound generator connected to said divider and responsive thereto for generating said medial-beat sound, and means for audibly displaying said tempo-sound obtained by said tempo-sound generator, said down-beat sound obtained by said down-beat sound generator, and said medial-beat sound obtained by said medial-beat sound generator to generate a regularly strong and weak accentuated tempo-sound.

3. An electronic metronome comprising an oscillator to generate pulses of constant high frequency, a variable divider having a switch assembly for selecting and determining a combination of resetting of the flip-flops in the variable divider according to a desired tempo, said variable divider receiving the pulses of said oscillator and said switch assembly including a plurality of switch groups ($S_{1-1}$ to $S_{1-5}$: one group, $S_{2-1}$ to $S_{2-4}$: another group, - - - in FIG. 3) corresponding to a range of tempos, which are desired for musical use (tempos of 208 to 40), to transmit the output of the variable divider to the resetting terminals of the corresponding flip-flops ($S_{1-1}$ to $S_{1-5}$; to $R_1$ to $R_5$, $S_{2-1}$ to $S_{2-4}$; to $R_1$, $R_3$ to $R_5$, - - - in FIG. 3), a divider ($F_7$ and $F_8$) to selectively divide said output of the variable divider into divided frequency pulse signals, and a driving means (tempo-sound generator or decoder driver) to drive an indicating means (loud-speaker or light emitting element) in response to the divided frequency pulse signals.

4. An electronic metronome according to claim 3, wherein said indicating means is a tempo-sound generator and said indicating means is a loudspeaker.

5. An electronic metronome comprising an oscillator to generate pulses of constant high frequency, a first variable divider (2 in FIGS. 7, 9 and 11) having a switch assembly (3 in FIGS. 7, 9 and 11) for selecting and determining the dividing number of the variable divider according to a desired tempo, said variable divider receiving the pulses of said oscillator and therewith producing output signals corresponding to the selected tempo, a tempo-sound generator (4 in FIGS. 7, 9 and 11) to generate tempo sound signals in response to the output signals of the first variable divider, a second variable divider (2A in FIGS. 7, 9 and 11) for producing down-beat signals by dividing the output signals of said first variable divider, said second variable divider having a down-beat selecting switch assembly (3A in FIGS. 7 to 9, 11) for selecting and determining a full counting number before every resetting of the second variable divider according to a desired time (beat), a down-beat sound generator (4A in FIGS. 7, 9, 11) to generate down-beat sound signals in response to the down-beat signals of said second variable divider, and an audible sound generator (loudspeaker) to generate tempo sound of the desired tempo and time (beat) with the tempo and down-beat signals.

6. an electronic metronome comprising an oscillator to generate pulses of constant high frequency, a first variable divider (2 in FIGS. 7, 9 and 11) having a switch assembly (3 in FIGS. 7, 9 and 11) for selecting and determining the dividing number of the variable divider according to a desired tempo, said variable divider receiving the pulses of said oscillator and therewith producing output signals corresponding the selected tempo, a tempo-sound generator (59, 58 and 56 in FIG. 14 or 4 in FIGS. 7, 9 and 11) to generate tempo sound signals in response to the output signals of said first variable divider, a second variable divider or counter (42 in FIGS. 12 and 13) for producing down-beat and medial beat signals at separate output terminals thereof by dividing the output signals of said first variable divider, said second variable divider including a down-beat and meidal-beat selecting switch assembly (43 in FIG. 12 or $SW_1$ to $SW_4$ with gates $G_4$ and $G_5$ in FIG. 13) for selecting and determining a full counting number before every resetting of the second variable divider according to a desired time and for selecting and determining medial-beat order in the time, a down-beat sound generator (61 to 64 in FIG. 14 or 4A in FIGS. 7, 9 and 11) to generate down-beat sound signals in response to the down-beat signals of said second variable divider, a medial-beat sound generator (60, 56 to 58 in FIG. 14 or 46 in FIG. 12) to generate medial-beat sound signals in response to the medial-beat signals of said second variable divider, and an audible sound generator (loudspeaker) to generate tempo sound of the desired tempo and time (beat) with the tempo, down-beat and medial-beat sound signals.

7. An electronic metronome comprising an oscillator to generate pulses of constant high frequency, a first variable divider (2 in FIG. 4) having a switch assembly (3 in FIG. 4) for selecting and determining the dividing number of the variable divider according to a desired tempo, said variable divider receiving the pulses of said oscillator and therewith producing output signals an integral times higher than the selected tempo, a scanning circuit (7 in FIG. 4 and 11 to 14 in FIG. 5, and **9, 9*a* and 10 in FIG. 6) including flip-flops and decoder-driver, said flip-flops dividing the output signals of said first variable divider to tempo signals equal to the selected tempo and giving encoded scanning signals, which stepping-forward cycle is synchronized with the pulses of said first variable divider, to the decoder driver, a light emitting arrangement (8 in FIGS. 4 and 6, 15 to 22 in FIG. 5) to display light flows in response to the output of the decoder driver which is decoded from the encoded scanning signals, a temposound generator (4 in FIG. 4**) to generate tempo sound signals in response to the tempo signals, and an audible sound generator (loud-speaker) to generate tempo sound of the desired tempo.

8. An electronic metronome according to claim 7, further comprising a second variable divider (2A in FIGS. 9 and 11) for producing down-beat signals by dividing the tempo signals, said second variable divider including a down-beat selecting switch assembly (3A in FIGS. 9 and 11) for selecting and determining a full counting number before every resetting of the second variable divider according to a desired time (beat), a down-beat sound generator (4A in FIGS. 9 and 11) to generate down-beat sound signals in response to the down-beat signals of said second variable divider, and an audible sound generator (loudspeaker) to generate tempo sound of the desired tempo and time(beat) with the tempo and down-beat signals.

9. An electronic metronome according to claim 7, further comprising a second variable divider or counter (42 in FIGS. 12 and 13) for producing down-beat and medial-beat signals at separate output terminals thereof by dividing the tempo signals, said second variable divider including a down-beat and medial-beat selecting switch assembly (43 in FIG. 12 and $SW_1$ to $SW_4$ etc. with gates $G_4$ and $G_5$ etc. in FIG. 13) for selecting and determining a full counting number before every resetting of the second variable divider according to a desired time, said light emitting arrangement including a plurality of light emitting units (LAMPs in FIG. 15) each includes a plurality of light emitting elements, said light emitting elements being successively energized by the output of said decoder driver (14, $D_1$ to $D_3$ in FIG. 15), a decoder selecter ($F''_4$, $F''_5$, $G_1$ to $G_3$ in FIG. 15) to select one of the light emitting units step by step according to the tempo signals and to reset to the first unit according to the down-beat or medial-beat signals of the second variable divider so that the light emitting arrangement displays light flows including local light flow within each of the units which indicates baton movement in a beat and unit light flow from a unit to another which indicates the tempo and time, a donw-beat sound generator to generate down-beat sound signals in response to the down-beat signals, a medial-beat sound generator to generate medial-beat sound signals in response to the medial-beat signals, and an audible sound generator to generate tempo sound of the desired tempo and time with the tempo, down-beat and medial-beat sound signals.

* * * * *